United States Patent [19]

McInerney et al.

[11] 3,942,355

[45] Mar. 9, 1976

[54] HOT WATER GENERATOR AND METHOD FOR SHOCK TESTING FABRICATED PIPING COMPONENTS

[75] Inventors: Michael J. McInerney, Highland Park; Robert T. Brady, Elmhurst, both of Ill.

[73] Assignee: Vapor Corporation, Chicago, Ill.

[22] Filed: Sept. 13, 1974

[21] Appl. No.: 505,654

Related U.S. Application Data

[62] Division of Ser. No. 437,249, Jan. 28, 1974, Pat. No. 3,890,936.

[52] U.S. Cl. ..... 73/15 R

[51] Int. Cl.[2] ..... G01N 25/00

[58] Field of Search ..... 73/15 R, 15.4; 122/248, 122/448; 165/11; 236/20

[56] References Cited

UNITED STATES PATENTS

| | | | |
|---|---|---|---|
| 2,717,581 | 9/1955 | Edwards | 122/448 |
| 2,790,435 | 4/1957 | Johnson | 122/250 X |
| 2,948,516 | 8/1960 | Martinelli et al. | 165/11 X |
| 3,359,949 | 12/1967 | Bjarnason et al. | 122/48 |
| 3,450,105 | 6/1969 | Osburn | 236/20 |
| 3,612,004 | 10/1971 | Cancilla et al. | 122/250 |
| 3,739,839 | 6/1973 | Light | 165/11 |

*Primary Examiner*—Herbert Goldstein

*Attorney, Agent, or Firm*—Francis J. Lidd

[57] ABSTRACT

A hot water generator capable of producing a maximum rate of water temperature increase without generation of vapors including a heat exchanger in the form of an annularly shaped helical coil through which the water to be heated is pumped and which is connected to a piping system including a load and a combustor for rapidly providing increased combustion which is controlled in response to the temperature of the water at the outlet of the coil so that the heater can produce a maximum rate of water temperature rise without causing boiling and generating vapors in the coil. The method concerns the shock testing of piping components by producing nearly theoretical maximum heat flux rate very quickly.

4 Claims, 14 Drawing Figures

CHANGE IN SET POINT (Increase)

CHANGE IN LOAD (Increase)

HOT WATER GENERATOR AND METHOD FOR SHOCK TESTING FABRICATED PIPING COMPONENTS

This is a division of application Ser. No. 437,249, filed Jan. 28, 1974, now U.S. Pat. No. 3,890,936, dated June 24, 1975.

This invention relates in general to hot water generators and more particularly to a hot water generator operating at high temperatures so the heat exchanger of the generator will produce a maximum rate of heat absorption and therefore temperature rise without nucleation.

Heretofore, hot water generators have operated well below the maximum heat release obtainable because of heat exchange and pressure control systems which would result in generating transient pockets of vapor, some of which might become superheated. Pressure transients produced by these vapor pockets generate "hammer" or load pressure transients in the heat exchanger portion of the generator which is objectionable in damage caused to the heat exchanger and audible noise emitted. Superheated vapor pockets localize overheating of heat exchanging surfaces that result in decreased life. Vaporization of water causes film temperatures at sufficient high levels which may produce scaling and/or corrosion. Accordingly, it is important that the water heated by the generator never enter the vapor phase.

A prior known water heating apparatus is shown in U.S. Pat. No. 3,282,257, wherein a heat exchange structure similar to that of the present invention is used in connection with a steam drum to produce controlled quality steam. This heater operates at approximately 75 percent of the maximum heat release due to variations in load pressure.

A boiler for producing rapid water temperature increases is shown in U.S. Pat. No. 3,651,790, which concerns the use of complex heat transfer structures for increasing the heat exchange surface. Structures of this type are difficult and expensive to manufacture. Moreover, such structures have non-uniform internal pressure distribution during thermal and flow transients which result in the generation of undesirable vapor pockets.

Another complex type of heat transfer water generator is shown in U.S. Pat. 3,773,019. This structure would likewise be difficult and expensive to manufacture.

Heretofore, fluid loop components were tested for static pressure only, usually by hydraulic means at easy to achieve temperatures. It was assumed that temperature effects were either insignificant or could be predetermined. Recently, however, utilization of large thermal heat sources such as nuclear reactors, and subsequent increased concern for safety has produced a requirement for testing units under pressure, temperature and temperature rates of rise. Testing under rapid temperature changes is therefore required to insure operation of fluid loop components during variations in thermal strain produced by the combination of temperature and pressure.

The present invention utilizes a heat exchanger structure and a combustor similar to that shown in the aforementioned U.S. Pat. No. 3,282,257, together with a unique control system for obtaining the maximum rate of water temperature increase without generation of vapor pockets. For example, the system of the invention can operate to heat water from a temperature of about 562° F. and a pressure of about 2282 psig to a temperature of about 627° F. and a pressure of about 2266 psig in about 50 seconds. This allows the maximum heat flux to be absorbed by the heat exchange structure without moving into the area of nucleate or more advanced stages of boiling corresponding to the pressures involved. Accordingly, the hot water generator of the invention is capable of shock testing high performance fabricated piping components such as valves, regulators, heat exchangers and the like, by subjecting a component to a rapid water temperature rise without nucleation or the generation of vapor pockets.

The controls for operating the generator to obtain the rapid temperature rise in the water heated includes a temperature controller monitoring the outlet temperature of the water heated by the generator and producing a signal for operating a high speed air fuel actuator to provide the maximum permissible combustion rate capable of being handled by the heat exchanger structure of the generator without generating vapor pockets in the water being heated. A blower generating combustion air for the combustor has its output controlled by a damper connected to the actuator. A fuel metering valve delivering fuel to the combustor is also controlled by the actuator. A 24-to-1 turndown ratio of the generator permits generation of a "wall of water" which produces rapid increases in the water outlet temperature within accurately controlled flow and pressure limits.

It is therefore an object of the present invention to provide a high speed hot water generator capable of producing a high rate of temperature increase approaching the theoretical maximum change in water temperature without generating vapor pockets.

Another object of this invention is in the provision of a hot water generator and method for shock testing high performance fabricated piping components by subjecting a component to a rapid temperature rise of water without nucleation.

Still another object of this invention is in the provision of a high speed hot water generator including controls that are capable of operating the generator to provide the maximum rapid rate of temperature change without generating vapor pockets in the liquid.

A still further object of the invention is in the provision of a hot water generator having a heat exchanger which may be efficiently and inexpensively manufactured and which has long service life where controlled heat input and extraction produces a maximum rate of heat absorption and therefore temperature rise.

Other objects, features and advantages of the invention will be apparent from the following detailed disclosure, taken in conjunction with the accompanying sheets of drawings, wherein like reference numerals refer to like parts, in which.

Figure 9:
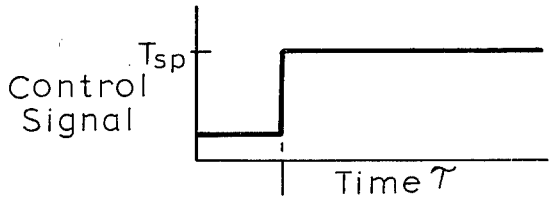
Figure 10:
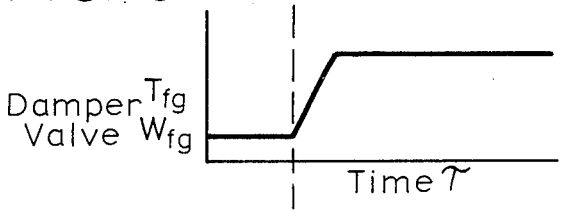
Figure 11:
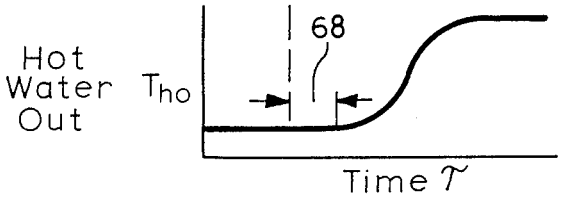
Figure 12:
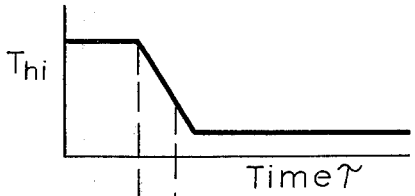
Figure 13:
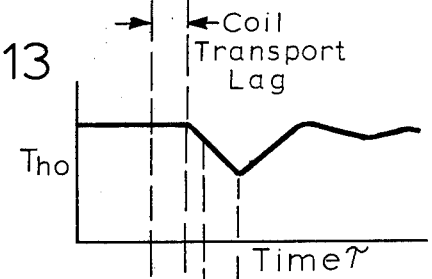
Figure 14:
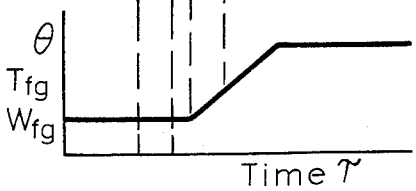

FIGS. 9, 10 and 11 are graphical illustrations of operations pursuant to a change in the set point temperature of the controller in relation to the control signal, the damper and the temperature of the hot water at the outlet of the heat exchanger; and FIGS. 12, 13 and 14 show the relationship during the change in load between the temperature of the hot water coming into the heat exchanger of the generator, the hot water leaving the heat exchanger and the flue gases transferred from the combustor to the heat exchanger.

Figure 1:
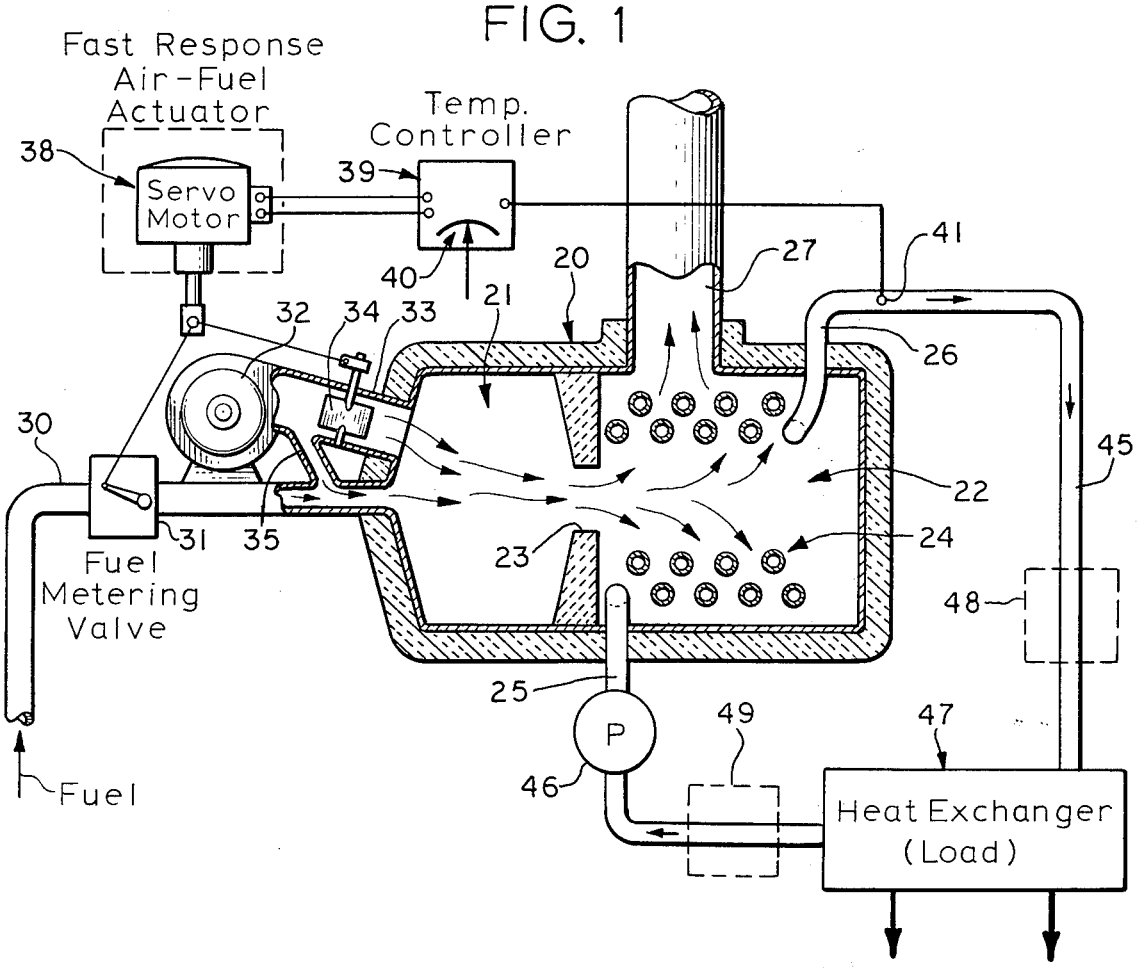
FIG. 1 is a somewhat diagrammatic and block view of the hot water generator according to the invention together with the controls and water flow loop.

Referring now to the drawings, and particularly to FIG. 1, the hot water generator of the invention is diagrammatically illustrated as including a housing 20 enclosing a combustor section 21 and a coil section 22. A choke 23 is provided within the housing between the combustor section and the coil section to direct the flow of gases from the combustor section to the coil section. Within the coil section 22, a coil or heat exchanger in the form of a coil and designated generally by the numeral 24 includes a plurality of watertubes. The coil is annularly shaped and helical in form and wherein the watertubes are arranged in radially arranged layers and longitudinally spaced or arranged rows with an inlet 25 at the outermost layer of watertubes and an outlet 26 at the innermost layer of watertubes. Combustion or flue gases generated in the combustor section 21 flow through the choke 23 into the central area of the coil 24 outwardly and through a flue gas outlet 27. While the generator is shown diagrammatically, it will be appreciated that this part of the generator is essentially of a type shown in the aforementioned U.S. Pat. No. 3,282,257. The helical watertubes define a path for the water which picks up heat from the coil that is absorbed from the flue gases which involves the transfer of heat to the minimum amount of water moving through the coils. It is important that minimum amount of water is involved in the heat transfer process in order to obtain the desired rapid rise in temperature of the water.

Combustion gases are generated from an appropriate fossil fuel and air mixture. Fuel may be a natural gas or other suitable fossil fuel which is delivered from a suitable source of supply through a fuel line 30 to the combustor section or the combustion chamber in the combustor section. A metering valve 31 controls the fuel flow in the combustor section.

Primary air or combustion air is generated by a blower 32 and delivered through a duct 33 to the combustor section 21. A damper 34 is provided in the duct to control the air flow through the duct. In order to maintain stability of combustion at low fire condition, a small amount of air is bled from the duct 33 ahead of the damper into the fuel line 30 by a bleed line 35 to provide some mixture of air with the fuel that is delivered by the fuel line into the combustor section. This is important in order to provide a high turndown ratio from high fire to low fire. More specifically, it assists in providing about a 24-to-1 turndown ratio in order to provide the necessary increase in temperature and obtain the necessary shock testing in connection with the shock testing of fabricated components according to the invention.

A high speed air fuel actuator 38 is mechanically coupled to the metering valve 31 and the damper 34 for controlling the operation thereof and therefore the air fuel flow into the combustion section 21. This actuator receives a signal from a temperature controller 39 of a suitable type which responds to a set point indicator 40 and the temperature of the hot water at the outlet 26 of the heat exchanger 24 by virtue of a suitable temperature measuring instrument 41.

A pipe or conduit 45 is connected between the inlet end and outlet end of the coil or heat exchanger 24. A pump 46 is provided in the piping 45 to cause constant flow of water through the entire water path or loop at all times at a desired flow rate. Therefore, forced circulation of water is established through the coil 24. A load 47 is also provided in the pipe 45 for loading the system. As shown, the load is in the form of a heat exchanger but may be of any desirable form although it should be such as to provide a continuous path in the piping 45. In the event that a fabricated component to be shock tested is a heat exchanger, such can be inserted at the load 47 position. Should the component to be tested be in the form of a valve, a regulator or the like, such can be mounted in the piping 45 at the position 48 ahead of the load 47 or at the position 49 between the load and the pump 46. The load 47 would be matched with the coil capacity of the generator.

Figure 2:
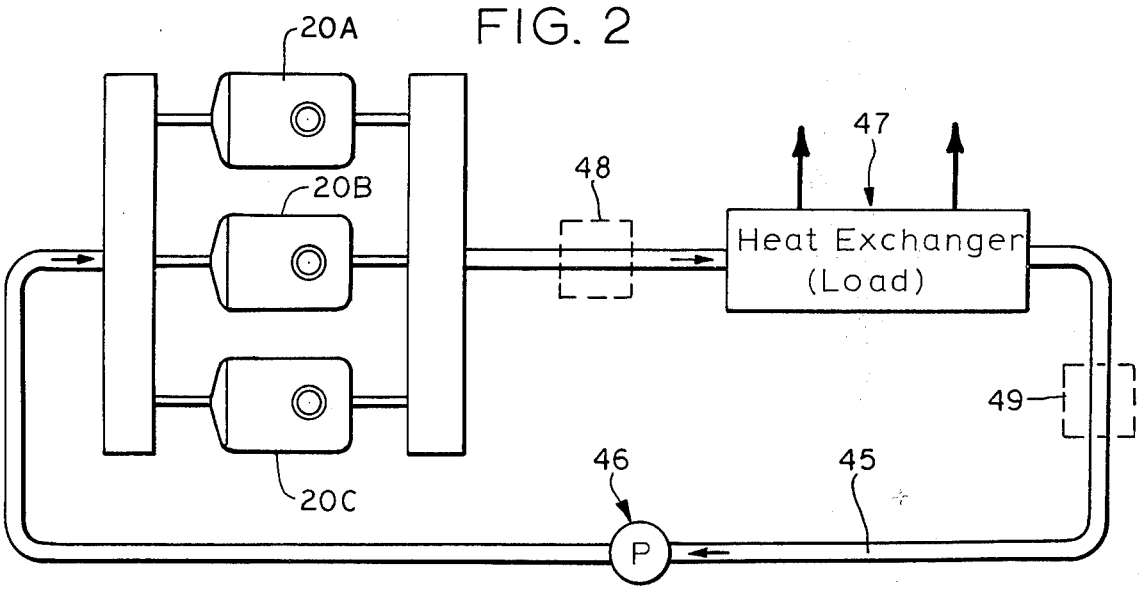
FIG. 2 is a somewhat diagrammatic view of a system including a plurality of hot water generators connected in parallel in connection with the shock testing of a piping component.

As seen in FIG. 2, in the event that the load is of such a magnitude that a single hot water generator would be insufficient, a plurality of hot water generators may be connected in parallel, as shown by the hot water generators 20A, 20B and 20C. Suitable manifolds at the inlet and outlet will be provided to facilitate the parallel connecting of such generators. While three generators are shown in FIG. 2, it can be appreciated that any number may be connected in parallel depending on the load. It can be appreciated that suitable balancing valves may be provided at the outlets of parallel connected generators so that the same temperature and pressure conditions of each generator is delivered into the outlet manifold.

The generators may use any suitable type of fossil fuel as already mentioned. The water used in the system will be de-aerated, de-mineralized, and perhaps otherwise treated.

The air fuel actuator 38 may be of any suitable type which provides a fast enough response which is necessary in order to enable the rapid rise in temperature of the liquid in the heat exchanger of the generator and also to prevent nucleation. For example, if the actuator will provide a full stroking time in 2 seconds or less, it will be able to provide the necessary quick response needed for the generator of the present invention. The response must be faster than the heat absorption capacity of the heat exchanger of the generator.

Figure 5:
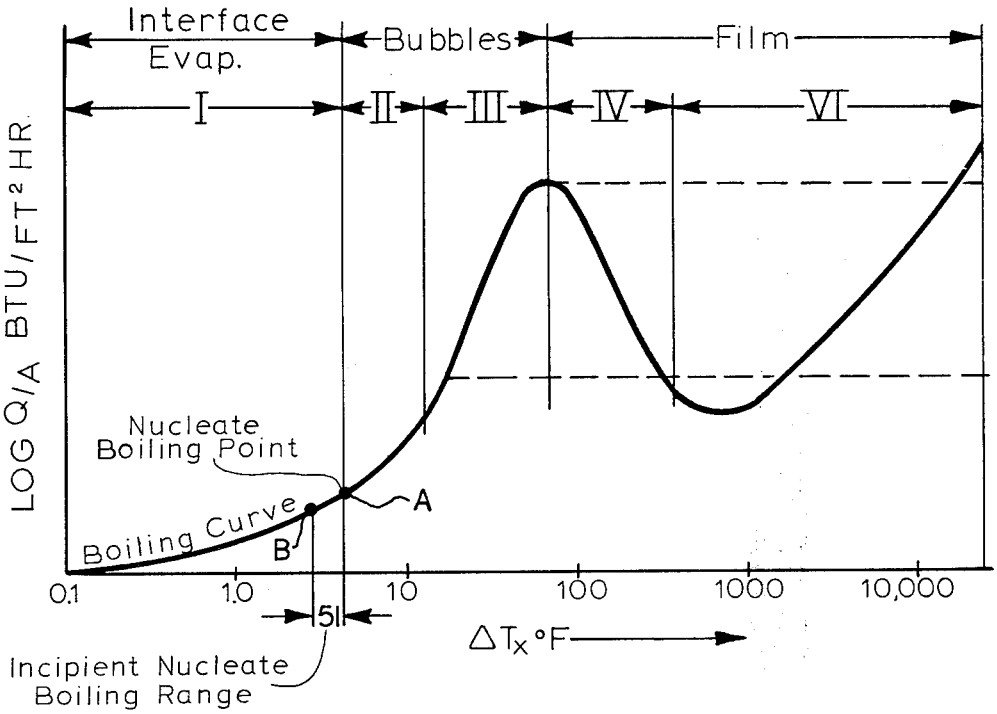
FIG. 5 is a typical boiling curve illustrating boiling regimes for hot water generators.

The typical boiling curve illustrating boiling regimes for hot water generators is shown in FIG. 5. Most hot water systems involve operating in a state of unsteady equilibrium where several of the boiling regimes illustrated in FIG. 5 are traversed. It is preferable that a system operate in the incipient nucleate boiling range indicated at 51 which is just below the nucleate boiling point A, where the most efficient heat transfer is available. The system of the present invention operates at point B. Overshoot of the maximum heat rate can move the operation of a system into the unstable boiling regions resulting in damage or destruction of the heat exchange surfaces. The curve of FIG. 5 shows the change in temperature plotted along the horizontal and the heat flow rate along the vertical.

Figure 6:
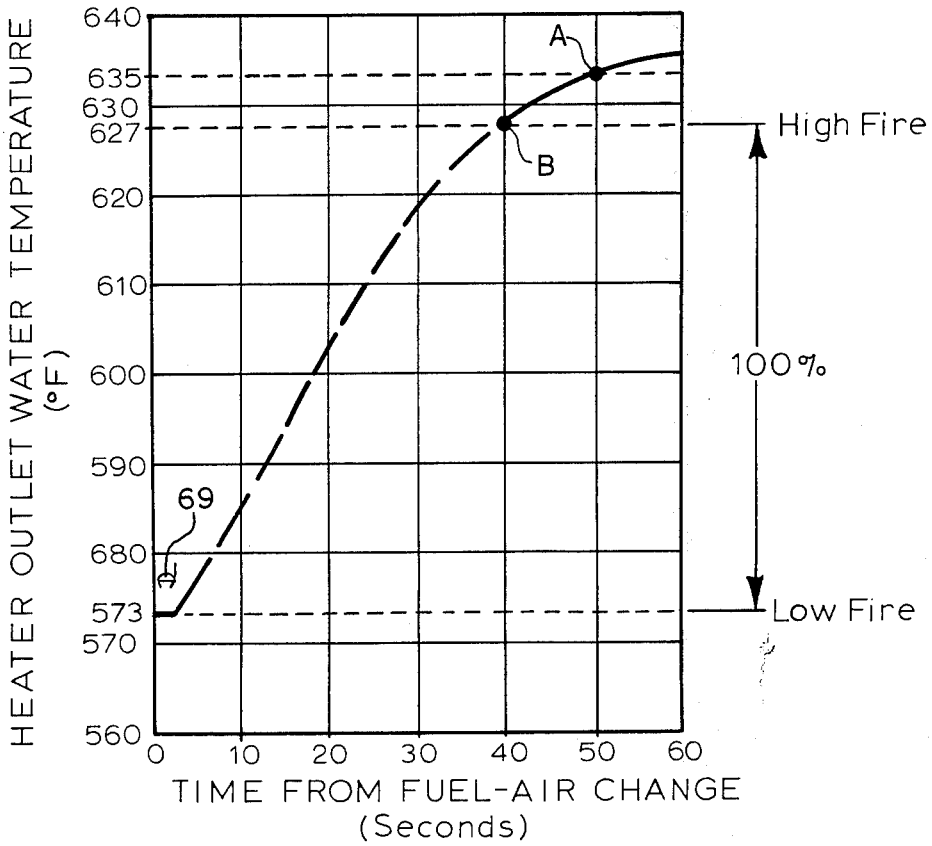
FIG. 6 is a graphical illustration of the time response plotted against heater water outlet temperature illustrating the low fire to high fire conditions of the generator according to the present invention and the maximum temperature rise without nucleation.

The rate of rise in temperature is dictated by the maximum heat flux which can be absorbed by the heat exchanger of the generator without moving into the area of nucleate or more advanced stages of boiling corresponding to the pressures involved. An illustration of the temperature-time response of a generator according to the present invention is shown in FIG. 6 wherein time in seconds is plotted along the horizontal and heater outlet water temperature is plotted along the vertical. As illustrated, the time taken to move from low fire to high fire or 100 percent firing rate of the generator is about 40 seconds, where the low-fire temperature is 573° F. and the high-fire temperature is about 627° F. Likewise, the rate of drop in temperature is dictated by the maximum heat flux absorbable by the heat exchanger. The "trip" point A and the normal operating point B are also shown here.

Figure 3:
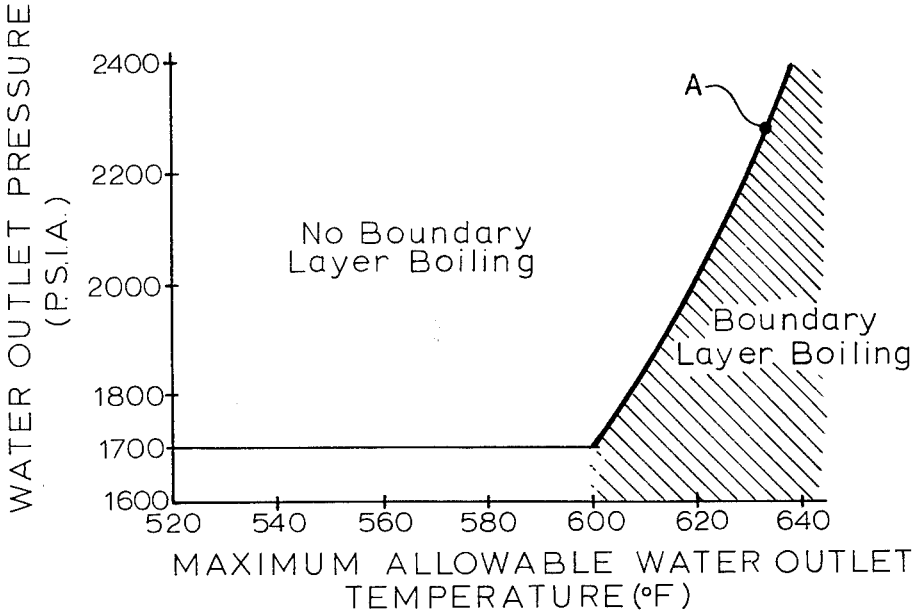
FIG. 3 is a graphical illustration of the maximum allowable water temperature at the hot water generator outlet as a function of outlet pressure for a hot water generator according to the present invention.
Figure 7:
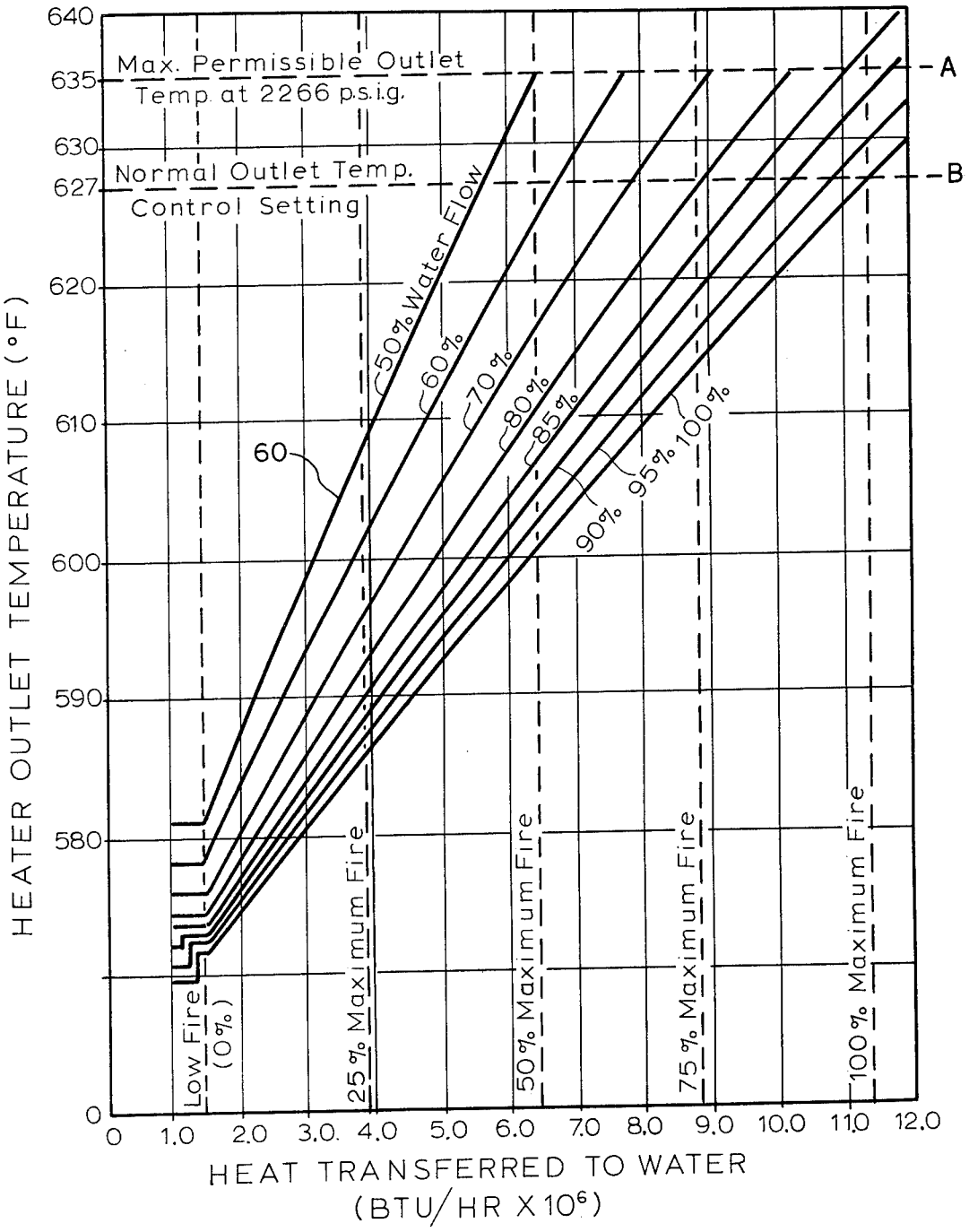
FIG. 7 is a graphical illustration showing the steady state of maximum fire rates allowable for operation between low fire outlet heater temperature and maximum allowable outlet temperature without boundary layer boiling.

The curve in FIG. 3 relates to the maximum allowable water temperature at the outlet of the coil as a function of outlet pressure for the generator of the invention to illustrate what temperature and pressure relationship must be maintained to prevent nucleation. The region on the left side of the curve represents no boundary layer boiling for the coil, while the shaded region on the right side of the curve represents the area to be avoided where coil boundary layer boiling does exist. Accordingly, during temperature rise of the water, the relationship between the temperature and the pressure must be in the region of the left of the curve to prevent boiling. The loci of point A from FIG. 5 is shown for water flow rates from 50 to 100 percent if the fuel inputs of FIG. 7 are adhered to.

Figure 4:
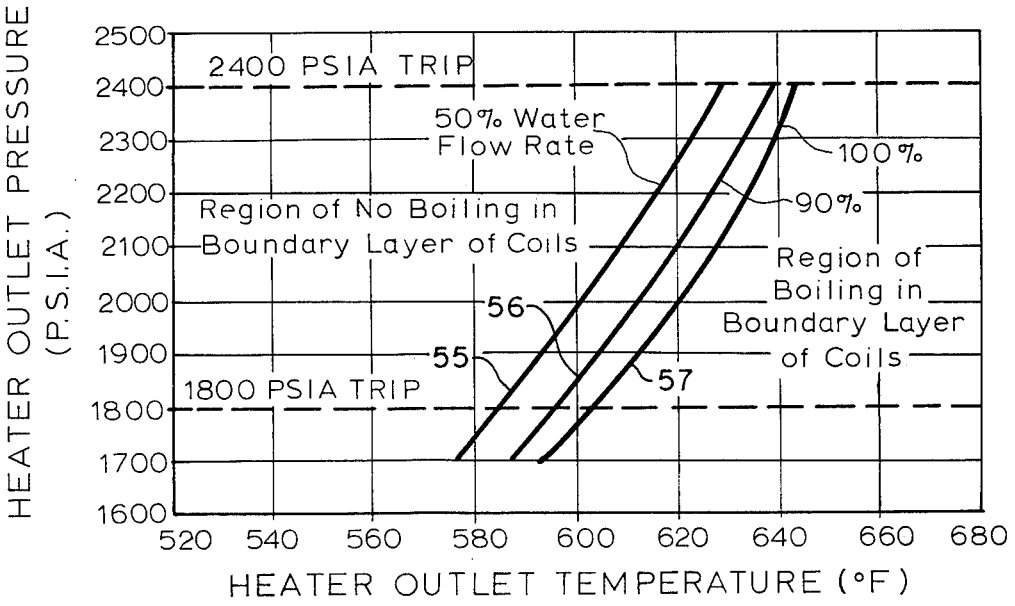
FIG. 4 is a graphical illustration of the maximum outlet water pressure and temperature of a hot water generator according to the invention as a function of water flow rate for prevention of boiling in the heat exchanger of the generator.

The curves shown in FIG. 4 represent the limiting hot water generator outlet water pressure and temperature as a function of the water flow rate for the prevention of boiling in the coil boundary layer therein. Heater outlet temperature in degrees Farenheit is plotted along the horizontal, while heater outlet pressure in psia is plotted along the vertical. Numbers 55, 56 and 57 respectively represent 50 percent, 90 percent and 100 percent water flow rates. Regions of no boiling are to the left of the curves, while regions of boiling are to he right of the curves. The steady state maximum temperatures allowable are reached at approximately 2400 psia at temperatures of 630°, 638° and 642° F. for the 50, 90, and 100 percent water flow rates. Accordingly, the 2400 psia limitation is indicated as a "trip" point which is a pressure that must be maintained or exceeded in order to prevent entering the boiling region which is shown in the shaded portion in FIG. 3.

The operation of the generator of the present invention according to changing from low fire to high fire conditions involves raising a nominal or residual temperatureat low fire and establishment of the water flow rate at a value corresponding to the amount of heat required. This is illustrated in FIG. 7. The curves in FIG. 7 show heat transfer to the water in btu's per hour times $10^6$ along the horizontal and heater outlet temperature in degrees Farenheit along the vertical. These curves illustrate maximum fuel fire rates allowable for operation between the low fire heater outlet temperature and maximum allowable outlet temperature without boundary layer boiling. The percent water flow curves are shown to be 50, 60, 70, 80, 85, 90, 95, 100. The 100 percent water flow rate represents the maximum heat output of the system. These curves concern a generator system with a capability of an output of about 12,000,000 but's per hour. The maximum fuel firing rate will vary depending upon the water flow rate required. Rapid application of the correct fuel and air mixture to approximately 50 percent of the rated flow capacity of the generator of the present invention results in a temperature increase along the path of curve 60 where the desired heat flux capability is reached at 627° F. and the associated controls for handling the fuel and air mixture trip and thereby remove the heat input. A temperature higher than 635° F. will cause boiling at this water flow rate. Further, it is not possible to use a higher maximum fire rate. The time required to meet the 627° point is approximately 50 seconds.

It can be appreciated that a definite relationship exists between pressure, temperature and flow rate for water heated at 100 percent maximum firing rate without creating vapor pockets. Exemplary of flow rate capacity for a generator having the characteristics illustrated in FIG. 7 are as follows:

| Water Flow at Maximum Fuel Firing Rates (%) | Minimum Flow Velocity Inside Tube (ft/sec) | Flow Capacity Inside Tube (lb/hr) |
|---|---|---|
| 100 | 5.8 | 124,833 |
| 95 | 5.5 | 118,591 |
| 90 | 5.2 | 112,350 |
| 85 | 4.9 | 106,108 |
| 80 | 4.6 | 99,866 |
| 70 | 4.1 | 87,383 |
| 60 | 3.5 | 74,900 |
| 50 | 2.9 | 62,417 |

Figure 8:
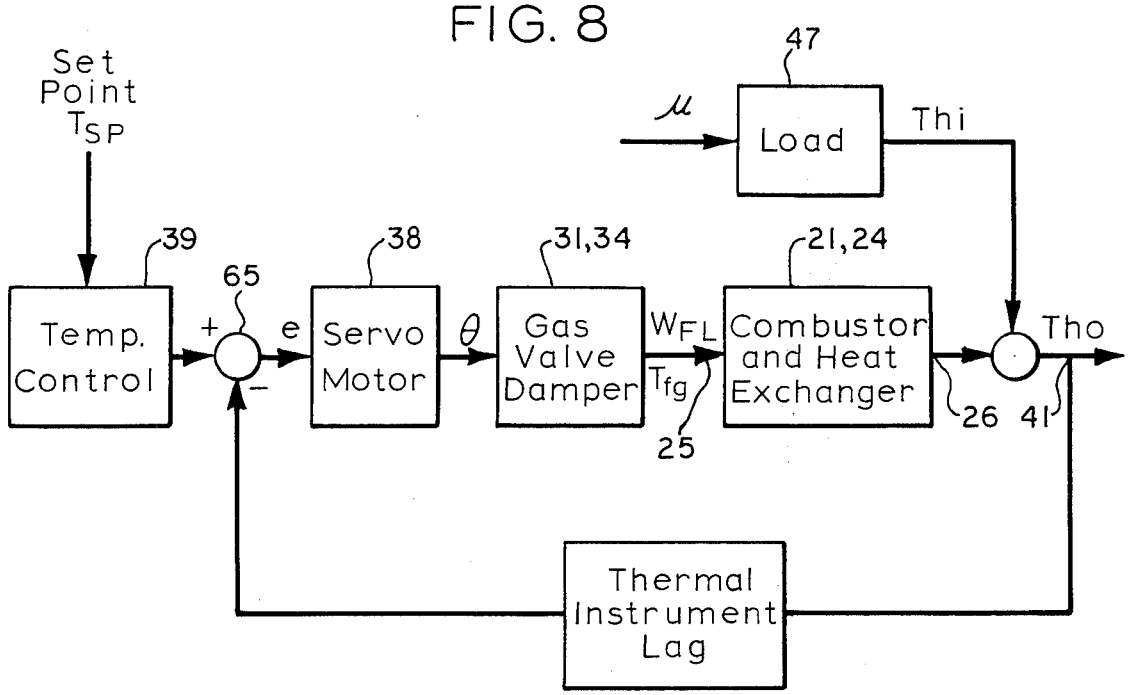
FIG. 8 is a block diagram of the air fuel control system of the generator of the present invention.

The block diagram of the system shown in FIG. 8 illustrates the temperature control 39 as receiving the set point temperature and delivering a signal to a summing junction 65 which receives a feedback from the temperature of the hot water out ($T_{ho}$) which is taken at the temperature measuring device 41 in the outlet of the heat exchanger 24. The summation of the feedback signal and the signal from the temperature controller is delivered to the servo motor or actuator 38 which controls the operation of the gas valve 31 and the damper 34. The operation of the gas valve 31 and the damper 34 results in the weight and temperature of the flue gas in the combustor and the heat exchanger 21, 24. Load 47, which removes heat and therefore determines the temperature of the hot water into the heat exchanger, effects the overall operation of the system.

The response to the change in set point of the temperature controller during an increase in temperature is illustrated in FIGS. 9, 10 and 11 as plotted against time. In FIG. 9 the control signal variation of the set point temperature ($T_{sp}$) is illustrated as being increased along the full range of temperature increase desired of about 573° to 627° F. The temperature and weight of the flue gases ($T_{fg}$ and $W_{fg}$) are shown in FIG. 10 in relation to the damper and valve operation. The rise in the temperature of the hot water out ($T_{ho}$) of the heat exchanger is illustrated in FIG. 11. Note the dead zone 68 which is also illustrated at 69 in FIG. 6.

The change in load of the heat exchanger indicated by a decrease in temperature is illustrated with the relationship between the hot water temperature into the heat exchanger, the hot water temperature out of the heat exchanger, and the temperature and weight of the flue gases in the combustor and heat exchanger sections is shown in FIGS. 12, 13 and 14.

Accordingly, it will be seen from the foregoing that the hot water generator of the invention may be utilized in the method of shock testing of high performance piping components wherein it is desired to produce maximum heat flux rate without nucleation so as to provide a hot water generator with a heat exchanger of long service life.

It will be understood that modifications and variations may be effected without departing from the scope of the novel concepts of the present invention, but it is understood that this application is to be limited only by the scope of the appended claims.

The invention is hereby claimed as follows:

1. A method of thermal shock testing a high performance fabricated piping component by subjecting the component to a rapid water temperature rise without nucleation, wherein the method includes use of a hot water generator having a high turndown ratio for rapidly increasing the temperature of hot water to a point of substantially theoretical maximum heat absorption and temperature rise without nucleation, wherein the generator includes a housing defining connected coil and combustor sections, a coil in the coil section with an open central area for receiving combustion gases and defining a water flow path, an inlet and an outlet for said coil, piping connected between the inlet and outlet defining a closed loop water path, a load in the piping, a pump in the piping forcing constant water circulation through the closed loop, a fuel and air induction system including fuel and air controls coacting to deliver the proper mixture of fuel and air to the combustor section, said fuel and air induction system including a fuel line delivering fuel to the combustor section, a combustion air line delivering combustion air to the combustor section, and means continually bleeding air directly into the fuel line to maintain stable combustion in the combustor section at minimum fire conditions, a fast response actuator for said fuel and air controls, and a temperature controller providing operating signals to he actuator in response to a set point temperature and the water temperature of the coil outlet to operate the fuel and air controls and cause a rapid rate of temperature rise in the outlet water temperature without nucleation, said method comprising the steps of mounting said component in said piping connected between the inlet and outlet of the coil, operating said generator between low and high firing rates in a short period of time to produce the maximum heat flux absorbable by the load without incurring nucleate boiling, and observing the function of said component.

2. The method of claim 1, wherein the step of operating the generator between low and high firing rates includes monitoring the temperature of the water at the coil outlet to control the increase of firing rate between low and high and prevent nucleation at the coil-water interface.

3. The method of claim 1, wherein the step of operating the generator between low and high firing rates includes circulating the water in the closed loop and controlling the flow rate to maintain a pressure related to the water temperature to limit the maximum temperature rise just below the incipient nucleate boiling point of the water.

4. A method of thermal shock testing a high performance fabricated piping component by subjecting the component to a rapid water temperature rise without nucleation, wherein the method includes use of a hot water generator having a housing defining connected coil and combustor sections, a coil axially aligned in the coil section with an open central area for receiving combustion gases and defining a water flow path, an inlet and an outlet for said coil, piping outside the generator connected between the inlet and outlet of the coil to define therewith a continuous closed loop water flow path, a load in the piping, a pump in the piping causing a constant water flow in the flow path, a fuel and air induction system including a fuel burner delivering fuel to the combustor section and a blower for producing and delivering combustion air to the combustor section, a fuel line having a fuel metering valve therein and connected to the burner to deliver fuel thereto, a duct connecting the blower to the combustor section and having means therein for controlling the amount of combustion air to the combustor section, and means for maintaining stable combustion in the combustor section at minimum air-fuel openings comprising a combustion air bleed line ahead of the combustion air controlling means for continually bleeding a small amount of air directly into the fuel line downstream of the fuel metering valve, said method comprising the steps of mounting said component in said piping connected between the inlet and outlet of the coil, operating said generator between low and high firing rates in a short period of time to produce the maximum heat flux absorbable by the load without incurring nucleate boiling, and observing the function of said component.

* * * * *